US005186759A

United States Patent [19]

Yacobellis

[11] Patent Number: 5,186,759

[45] Date of Patent: Feb. 16, 1993

[54] METHOD FOR CLEANING AND REMOVING HARMFUL MICROORGANISMS FROM AN AIR CONDITIONING SYSTEMS

[76] Inventor: Tom Yacobellis, 972 16th Way, Palm Harbor, Fla. 34683

[21] Appl. No.: 801,321

[22] Filed: Dec. 2, 1991

Related U.S. Application Data

[63] Continuation-in-part of Ser. No. 611,832, Nov. 13, 1990, abandoned.

[51] Int. Cl.[5] ..... B08B 5/04; B08B 9/02

[52] U.S. Cl. ..... 134/21; 134/22.11; 134/22.13; 134/26

[58] Field of Search ..... 134/21, 22.1, 22.11, 134/22.12, 22.13, 26, 34, 42; 15/395; 427/236

[56] References Cited

U.S. PATENT DOCUMENTS 3,591,328 7/1971 Szappanyos ..... 427/236
4,780,333 10/1988 Smith et al. ..... 427/236
4,792,363 12/1988 Franklin, Jr. et al. ..... 134/8

*Primary Examiner*—Theodore Morris
*Assistant Examiner*—Saeed Chaudhry
*Attorney, Agent, or Firm*—Joseph C. Mason, Jr.; Ronald E. Smith

[57] ABSTRACT

A method for removing harmful microorganisms from an air conditioning system and for treating said system so that the microorganisms do not return to the system after the cleaning. The first step of the method includes a thorough mechanical cleaning of the system, including the step of removing loose dust and debris with a vacuum cleaner or any vacuum method. The mechanical cleaning is followed by a chemical cleaning. Isopropyl alcohol or any like substance is the preferred chemical cleaning agent because it acts as a microbiocide. A long-term microbiocide is also applied to the cleaned surfaces. An adhesive is then applied to the cleaned surfaces, and a liner of plastic or foil is placed in overlying relation to the cleaned surfaces to hold any loose insulation that might be present and to provide the system with low particulate buildup in the future and to prevent the return of the microorganisms. This lining will also provide a surface easily cleaned in the future.

10 Claims, No Drawings

METHOD FOR CLEANING AND REMOVING HARMFUL MICROORGANISMS FROM AN AIR CONDITIONING SYSTEMS

This is a continuation-in-part of copending application Ser. No. 07/611,832 filed on Nov. 13, 1990, abandoned.

BACKGROUND OF THE INVENTION

1. Technical Field

This invention relates, generally, to methods for stopping viral and bacterial growth in air conditioning systems. More particularly, it relates to a method whereby air-contacting surfaces of an air-conditioning system are covered with a material inhospitable to such microorganisms.

2. Description of the Prior Art

Legionnaires' disease and other ailments have been traced to microorganisms that live and reproduce in air conditioning systems. The inside of an air conditioning duct is particularly hospitable to the growth of microorganisms that grow well in dark, moist environments with large surface areas upon which to multiply. When the inside of a duct becomes dirty, the surface area available as a breeding ground for small life forms increases dramatically, and their numbers explode until they become a threat to human health.

Accordingly, inventors have devised a number of ways to clean the interior walls of airconditioning ducts in an effort to remove harmful life forms therefrom. Numerous vacuum brushes have been developed, for example, that facilitate removal of dust particles and the like from the inside of ducts to thereby decrease the surface area upon which microorganisms live.

However, it has been noted that the harmful life forms return even after the ducts have been laboriously cleaned. This is because dust and other surface area-increasing debris rapidly accumulate in the ducts and the life forms that survived the cleaning again multiply.

Some cleaning companies provide clean ductwork simply by removing the old, dirty ductwork and replacing it with clean, new ductwork. This is a very expensive, short term solution to the problem because it is just a matter of time until the harmful microorganisms again enter the system and multiply.

There is a need, then, for a cleaning method that has a permanent effect, but the knowledge heretofore accumulated neither teaches nor suggests what the steps of such a method might be.

SUMMARY OF THE INVENTION

Air conditioning systems are mechanically cleaned and then chemically cleaned with a microbiocide. Then, the exposed surfaces thereof are covered with a lining upon which microorganisms are unable to survive. The result is a permanently clean air conditioning system.

The novel treatment includes an initial cleaning that removes from the system all accumulated foreign debris. This initial cleaning is performed with mechanical brushing means. A chemical cleaning including a microbiocide follows. The cleaned surface is then protected from re-growth of microorganisms by applying thereto a thin film of a material that is inhospitable to such life forms. Visqueen (trademark) moisture barrier or foil made of aluminum or other flexible, flat material is employed as the liner. Metallic foils other than aluminum foil are also within the scope of this invention.

It is therefore understood that the primary object of this invention is to protect occupants of air conditioned structures from the microorganisms that cause Legionnaires'or any other sick building related disease associated with air conditioning systems and other air-borne life forms that are harmful to humans.

A related object is to accomplish the primary object by a technique that is inexpensive and thus affordable by most consumers.

These and other important objects, advantages and features of the invention will become apparent as this disclosure continues.

The invention accordingly comprises the features of construction, combination of elements and arrangement of parts that will be exemplified in the construction hereinafter set forth, and the scope of the invention will be indicated in the claims.

DETAILED DESCRIPTION OF THE PREFERRED EMBODIMENT

The entire process of completely cleaning an entire air conditioning and ductwork system and treating it to prevent re-appearance or re-growth of microorganisms will now be set forth.

As a preliminary step, the areas of the residence or commercial space under the supply registers of the air conditioning systems are covered to protect the floor or floor covering. Each register and the return air grille is then removed and taken outside the structure for a thorough cleaning. Specifically, the registers and grille are soaked in a cleaning solution for about thirty minutes to both dislodge the dirt thereon and to disinfect the surfaces thereof. These items are then removed from the solution and cleaned further with a high pressure water jet to get dirt, residual mold, and bacterial or viral growth out from under rivets and other hard to reach areas. Each item is then heavily sprayed with isopropyl alcohol or other suitable fast-drying microbiocide.

Next, a long-lasting biocide is sprayed thereon to destroy the remaining microorganisms so that even hypersensitive people will be comfortable in the treated structure. As used herein, the words "long-lasting" or "long term" biocide should be understood in their ordinary, well-understood sense, i.e., as referring to a biocide such as Oxine (trademark) having an effective lifetime between six months to two years. Similarly, the words "fast-drying" or "short term" biocide should also be understood as having their ordinary, well-known meaning, i.e., as referring to a biocide such as isopropyl alcohol having an effective lifetime of about twenty four hours or less.

It is common during construction of a building for foreign matter such as spray paint or popcorn to get into the supply register boxes. Thus, after the supply registers have been removed and placed in the cleaning solution, the boxes are mechanically scrubbed to remove such foreign matter to thereby decrease the amount of surface area upon which the microorganisms thrive.

Among the suitable mechanical cleaning aids are wire brushes, wheels, or cloth saturated with a neutral cleaning solution. Typically, these boxes are made of a fibrous insulating material the surface of which breaks down with the passage of time and becomes rough and uneven. Such a surface provides a perfect breeding ground for microorganisms. Accordingly, after the mechanical cleaning, the box surfaces are saturated with isopropyl alcohol or a similar fast-drying compound that kills bacteria and mold upon contact. Contact cement is then sprayed onto the exposed surface of each box and a layer of foil or Visqueen is applied in overlying relation thereto. Foil or Visqueen plastic are flexible and easy to install. More importantly, such materials present a flat surface or minimum surface area upon which microorganisms are unable to thrive. Unlike the fibrous insulating material with which the boxes are made, which has numerous hills and valleys that enable microorganisms to cling thereto, Visqueen plastic or aluminum or similar foils are substantially flat and provide a low resistance for any foreign particle to accumulate, as aforesaid. Thus, not even dust can cling thereto. The microorganisms are thus deprived of a surface upon which they can multiply. In this manner, neither mold, dust, bacterial, viruses, or other organic or inorganic substance may build up on the inner lining of the boxes and the primary object of this invention is achieved.

Significantly, it has been found that harmful life forms do not return to air conditioning systems treated in the manner outlined above. This contrasts sharply with the earlier teachings of full-scale ductwork replacement or full scale mechanical scrubbing and cleaning. The most thorough mechanical or chemical cleaning will always leave at least one hard to reach spot in the ductwork or boxes that continues to harbor microorganisms and those life forms will multiply and escape into the air conditioned environment once the system is returned to service. However, with the foil or Visqueen lining, no microorganism can survive because the area under the lining is hermetically sealed and any microorganism that survives the cleaning will perish from lack of oxygen. Even if an anaerobic life form were to survive beneath the lining, it could not escape into the air supplied to the occupants of the structure.

Essentially the same treatment is performed on the evaporator section of the air conditioning system. The blower housing is first removed to expose as much of the internal cavity thereof as possible to thereby facilitate its cleaning. The insulating material that lines the cavity is loose in most installations and provides a perfect environment for harmful organisms. This surface is first cleaned with soft-bristle brushes connected to an industrial vacuum to remove loose dirt and the loose insulation is then re-secured. As in the treatment of the supply register boxes, the insulation is saturated with a fast-drying microbiocide such as isopropyl alcohol and a long-lasting microbiocide is added as well to prevent long term mold growth. As before, after the surface has dried, an adhesive is applied thereto, and a foil or Visqueen is applied thereto to line the cavity. Advantageously, the foil or Visqueen (or other suitable material as empirical studies might suggest) also has the benefit of retaining the underlying insulation in place.

A neutral coil cleaner is then sprayed on the evaporator coils and this is followed by cleaning with a fifteen hundred pounds per square inch pressure washer. It is then followed by saturation with a fast drying microbiocide and the same treatment is then performed in the drain pan of the unit. All rusted surfaces are then cleaned and protected with a rust-preventing compound such as a galvanizing compound.

The entire evaporator system is then fog-misted with a fast-drying microbiocide and a long term microbiocide is applied to prevent long term mold growth.

It has also been discovered that blower wheels and blower motors also harbor harmful microorganisms. Therefore, the blower wheel is removed from the motor, an air hose and special cleaning agents are employed to clean the motor. The blower wheel (and the heating element of the system) are placed in the above-mentioned cleaning solution with the supply registers and return air grille and cleaned in the same manner. After the earlier-described treatment is performed, the blower wheel is placed back into the housing, and the blower and heating element are prepared for re-installation back into the unit and are re-installed when the treatment is concluded. Each wiring harness is hand cleaned with short and long term biocide treatment being applied.

The ductwork of the system is cleaned in substantially the same way as all of the other parts thereof. More particularly, the interior walls of the ductwork are first scrubbed using conventional scrubbing brushes to loosen dirt particles and other debris and vacuum means are employed to remove the loosened dirt and debris. Long term and short term microbiocides are then applied and an adhesive is applied to the cleaned interior walls. Said walls are then lined with Visqueen plastic, aluminum foil, or other suitable plastic or metallic foil In this manner, when the novel treatment has been completed, every interior surface of the air conditioning system will have been mechanically scrubbed, chemically cleaned, and covered with a liner. This is a permanent solution to the problem caused by harmful microorganisms.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein-described, and all statements of the scope of the invention which, as a matter of language, might be said to fall therebetween.

Now that the invention has been described.

What is claimed is:

1. A method for cleaning the ductwork and related parts of an air conditioning system, comprising the steps of:

scrubbing all exposed interior surfaces of the ductwork;

vacuuming said exposed interior surfaces;

chemically cleaning said surfaces, after the completion of said scrubbing and vacuuming, with an effective amount of a microbiocide having an effective period of about one day;

chemically cleaning said surfaces, after the completion of said scrubbing and vacuuming, with an effective amount of a microbiocide having an effective period of about six months to two years; and applying an adhesive to said exposed interior surfaces after completion of said scrubbing, vacuuming and chemical cleaning;

completely lining all of said surfaces with a flat, flexible liner that is adhered to said exposed interior surfaces;

said flat, flexible liner being a metallic foil and being inhospitable to the growth of life forms of the type that live in air conditioning ducts.

2. The method of claim 1, wherein said metallic foil is aluminum foil.

3. The method of claim 1, wherein said step of vacuuming said surfaces includes the step of using soft bristle vacuum brushes to loosen dirt and dust.

4. The method of claim 1, further comprising the step of removing all supply registers and return air grilles from the system, soaking said registers and grilles in a cleaning solution for a predetermined period of time, removing said registers and grilles from said solution at the expiration of said period of time, further cleaning said registers and grilles with a high pressure water jet, and heavily spraying said registers and grilles with a microbiocide.

5. The method of claim 1, further comprising the step of cleaning the evaporator section of said system by removing the blower housing to expose maximum surface area within said evaporator section, vacuuming the exposed surfaces, re-securing any loose insulation therein, and performing the steps as set forth in claim 1.

6. The method of claim 5, further comprising the step of spraying a neutral coil cleaner on the evaporator coils and further treating said coils by spraying them with a pressure washer.

7. The method of claim 6, further comprising the step of spraying the evaporator coils with an effective amount of microbiocide having an effective period of about one day and an effective amount of microbiocide having an effective period of about six months to two years.

8. The method of claim 7, further comprising the steps of fog misting the evaporator system with an effective amount of a microbiocide having an effective period of about one day and thereafter applying a microbiocide having an effective period of about six months to two years.

9. The method of claim 8, further comprising the step of removing a blower wheel from a blower housing, placing said blower wheel in a cleaning solution for a predetermined period of time, and cleaning a blower motor with a high pressure air hose and cleaning solution.

10. The method of claim 9, further comprising the step of cleaning a heating element of said system in said cleaning solution.

* * * * *